United States Patent [19]

Braid et al.

[11] Patent Number: 4,743,389

[45] Date of Patent: May 10, 1988

[54] N-ALKYL AMIDES AS FRICTION-REDUCERS FOR LUBRICANTS AND FUELS

[75] Inventors: Milton Braid, Haddonfield; Andrew G. Horodysky, Cherry Hill, both of N.J.

[73] Assignee: Mobil Oil Corporation, New York, N.Y.

[21] Appl. No.: 445,644

[22] Filed: Nov. 30, 1982

[51] Int. Cl.[4] ..... C10M 129/00

[52] U.S. Cl. ..... 252/51.5 A

[58] Field of Search ..... 252/51.5 A

[56] References Cited

U.S. PATENT DOCUMENTS

| | | | |
|---|---|---|---|
| 1,789,302 | 1/1931 | Calcott et al. | 252/51.5 A X |
| 3,192,910 | 7/1965 | Coffield et al. | 252/51.5 A X |
| 3,312,620 | 4/1967 | Low et al. | 252/51.5 A X |
| 3,778,372 | 12/1973 | Murphy | 252/51.5 A |
| 3,894,958 | 7/1975 | McCoy et al. | 252/51.5 A |
| 4,280,916 | 7/1981 | Richards et al. | 252/51.5 A X |

*Primary Examiner*—William R. Dixon, Jr.
*Assistant Examiner*—Cynthia A. Prezlock
*Attorney, Agent, or Firm*—A. J. McKillop; Michael G. Gilman; Howard M. Flournoy

[57] ABSTRACT

N-alkyl amides, particularly N-alkyl formamides, are effective friction-reducing additives for use in lubricants and fuels.

15 Claims, No Drawings

N-ALKYL AMIDES AS FRICTION-REDUCERS FOR LUBRICANTS AND FUELS

BACKGROUND OF THE INVENTION

1. Field of the Invention

This invention relates to lubricant compositions, i.e., oils of lubricating viscosity and greases prepared therefrom containing a friction reducing amount of an N-alkyl amide.

2. Description of the Prior Art

Amides have found wide-spread use in multiple lubricant applications such as multi-functional detergent/-dispersant applications in engine oil formulations. Amides such as n-pyridyl oleamides have been used as anti-rust additives, see U.S. Pat. No. 3,884,882. More particularly, this application is directed to long-chain N-alkyl formamides which have the advantage of being non-metallic, ashless and without any possible deleterious phosphorus or sulfur.

Many means have been employed to reduce overall friction in modern engines, particularly automobile engines. It is commonly understood that lubricants, by definition, reduce friction between moving surfaces. Friction reducing additives or agents which are added to lubricants in minor amounts significantly enhance the frictional properties of those lubricants without significantly impairing other physical properties such as viscosity, density, pour point and the like. Although amides broadly have been known to be used in lubricating compositions, see for example, U.S. Pat. No. 3,884,822 referred to hereinabove, this invention and the corresponding N-alkyl amides specifically N-alkyl formamides have no prior use or history of use as friction-reducing or friction modifying additives, or for that matter of use, in the major additive areas of anticorrosion or antioxidation in lubricating compositions.

SUMMARY OF THE INVENTION

The additive compounds useful in this invention are N-alkyl amides, and more particularly, N-alkyl formamides which can be derived by the reaction of primary hydrocarbyl amines with carboxylic acids such as formic acid, or by ammonolysis or formate esters. These amides significantly reduce friction when formulated into lubricants at concentrations of 1% or less. The novel lubricant compositions containing the described N-alkyl amides also, in addition to reducing friction, reduce wear on lubricated rubbing surfaces by virtue of their friction-reducing and lubricity properties. This can be a significant factor in substantially further improving the gasoline fuel economy of even today's fuel-efficient lubricants.

The N-alkyl amides embodied herein may be prepared from readily available, inexpensive raw materials by, for example, a one-step, one-pot condensation reaction.

The N-alkyl amides of the present invention can be represented by:

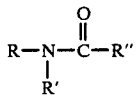

wherein R is a $C_{10}$ to $C_{30}$ hydrocarbyl or mixture of $C_{10}$ to $C_{20}$ hydrocarbyl. R can be alkyl, alkenyl, alkynyl, aryl, alkaryl, cycloalkyl, cycloaryl, etc. Some branching may be present, but R is preferably straight. R′ is R, or most preferably hydrogen. R″ is hydrogen or $C_1$ to $C_3$ alkyl. Friction reducing properties of these compounds are lessened when R′ is not hydrogen and R″ is not hydrogen. R can be dodecyl, tetradecyl, hexadecyl, pentadecyl, coco, oleyl, tallow, stearyl, isostearyl, and the like or mixtures thereof; mixtures are often preferred.

Having described the invention in general terms, the following are offered as specific illustrations thereof. It is to be understood, however, that they are merely illustrations and that the invention is not thereby limited except as by the appended claims.

DESCRIPTION OF SPECIFIC EMBODIMENTS

EXAMPLE 1

N-Coco formamide

Approximately 214 g of cocoamine, obtained commercially, and 50 g of toluene were charged to a 1 liter reactor equipped with agitator, heater and Dean-Stark tube with condenser. Approximately 57 g of 88% formic acid was added and the mixture was heated for 4½ hours until water evolution ceased. The reaction mixture was heated to approximately 180° C. and unreacted starting materials and solvent were removed by vacuum distillation. The product was filtered hot through paper. Upon cooling, the product formed an off-white, low melting point, waxy solid.

EXAMPLE 2

N-oleyl formamide

To oleylamine (commercially obtained) (107 g) there is added at room temperature methyl formate (30 g) and the mixture is stirred for 0.25 hour during which there is an exothermic temperature rise to 55° C. (refluxing). Additional methyl formate (30 g) is added to the reaction mixture and the temperature is maintained at 40°–45° C. by external heating for one hour. A small chip of sodium metal is added as a catalyst to insure complete reaction and heating is continued at 40°–45° C. for an additional hour. The reaction mixture is taken up in benzene washed with water, dried and stripped of solvent and metanol leaving the product N-oleyl formamide as a clear orange moderately viscous oil.

EXAMPLE 3

N,N-Dicoco formamide

The procedure as generally described in Example 1 was followed. Approximately 29 g of dicocoamine, obtained commercially, 75 g toluene and 50 g 88% formic acid were charged to a 1 liter reaction equipped as described in Example 1. The reaction contents were heated to approximately 180° C. over a period of 6 hours until water evolution ceased. Vacuum distillation was performed to remove relatively volatile unreacted starting materials and solvent. The product was filtered at approximately 110° C. through diatomaceous earth. The product was an amber colored low viscosity fluid.

The N-alkyl formamides derived as disclosed above were blended into a fully formulated engine oil (SAE 5W/30) and tested for friction reduction on Low Viscosity Friction Apparatus (LVFA).

EVALUATION OF THE PRODUCT

Low Viscosity Friction Apparatus (LVFA)

The Low Viscosity Friction Apparatus is used to measure the friction of test lubricants under various loads, temperature and sliding speeds. The LVFA consists of a flat SAE 1020 steel surface (diameter 1.5 inches) which is attached to a drive shaft and rotated over a stationary, raised, narrow-ringed SAE 1020 steel surface, area 0.08 square inches. Both surfaces are submerged in the test lubricant. Friction between the steel surfaces is measured as a function of the sliding speed at a lubricant temperature of 250° F. The friction between the rubbing surfaces is measured using a Torque Arm Strain Gauge System. The strain gauge output which is calibrated to be equal to the coefficient of friction is fed to the Y-axis on an X-Y plotter. The speed signal from the tachometer/generator is fed to the X-axis to minimize external friction. The piston is supported by an air bearing. The normal force loading the rubbing surfaces is regulated by air pressure on the bottom of the piston. The drive system consists of an infinitely variable speed hydraulic transmission driven by a ½ hp electric motor to vary the sliding speed. The output speed of the transmission is regulated by a lever/cam/motor arrangement.

Procedure

The rubbing surfaces and 12–13 ml of test lubricant are placed on the LVFA. A 500 psi load is applied, and the sliding speed is maintained at 30 fpm at ambient temperature for a few minutes. A plot of coefficients of friction ($U_k$) over a range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 500 psi, and 40 fpm sliding speed. Freshly polished steel specimens are used for each run. The surface of the steel is parallel ground to 4 to 8 microinches. The percentages by weight are percentages by weight of the total lubricating oil composition, including the usual additive package. The data are percent decrease in friction according to:

$$\frac{(U_k \text{ of oil alone} - U_k \text{ of oil plus additive})}{(U_k \text{ of oil alone})} \times 100$$

Thus, the value for the base oil alone, without any additional friction reducers, would be zero as shown in the Table below.

TABLE 1

Friction Characteristics Using the Low Velocity Friction Apparatus

| Example No. | Additive Conc. Wt. % | Reduction or % Change Coefficient of Friction 5 Ft./Min | 30 Ft./Min |
|---|---|---|---|
| Base Oil (fully formulated engine oil containing detergent/dispersant inhibitor package | — | 0 | 0 |
| Example 1 N—Coco formamide | 2 1 | 32 30 | 35 33 |
| Example 2 NW—Oleyl formamide | 2 | 24 | 30 |
| Example 3 N,N—Dicoco formamide | 2 | 13 | 18 |

From the data in the above Table, it is readily apparent that the subject N-alkyl amides significantly improve the friction-reducing properties of lubricants into which they are incorporated with reductions as high as 35%. Moreover, with the use of only 1% N-coco formamide, friction was reduced by 30 to 33%.

Generally speaking, the amount of additive in the lubricant compositions may range from as low as a 1/10th to about 10% by weight of the total lubricant composition. Preferred is from about 0.1 to about 2 weight percent.

The compositions hereof also include other materials normally present in additive packages, such as corrosion inhibitors, viscosity index improvers, extreme pressure agents, etc., including metallic phenates, sulfonates, succinimides, zinc dithiophosphates, methacrylate or olefin copolymers, etc. All of which impart their customary properties to the particular compositions and do not detract from the value of the compositions into which they are incorporated. In fact, lubricant compositions containing both N-alkylamides described herein and zinc dithiophosphates frequently exhibit the best frictional response. The metallic phosphorodithioate may synergistically improve friction reduction of the amides. Generally the total amount of all such other materials will not exceed about 10 to 20 weight percent.

Furthermore, the lubricants contemplated for use herein include both mineral and synthetic hydrocarbon oils of lubricating viscosity, mixtures of mineral and synthetic oils and greases prepared therefrom, and other solid lubricants. The synthetic oils may include polyisobutylenes, hydrogenated olefins, polypropylene glycol, di(2ethylhexyl)sebacate, dibutyl phthalate, neopentyl esters, pentaerythritol esters, trimethylol propane esters, fluorocarbons, silicate esters, silanes, hydrogenated mineral oils, chain-type polyphenyls, siloxanes and silicones, phenoxy phenylethers or mixtures thereof.

Fuel compositions comtemplated for use herein include both hydrocarbon fuels, including gasoline, naphtha and diesel fuels or alcoholic fuels or mixtures of alcoholic and hydrocarbon fuels. Fuel compositions can contain 10 to 1,000 pounds of additive per 1000 barrels of fuel or more preferably 25 to 250 pounds per 1000 barrels of fuel.

It it is understood by those of ordinary skill in the art that variations of this invention within the scope thereof can be made.

We claim:

1. A lubricant composition comprising a major proportion of an oil of lubricating viscosity or a grease prepared therefrom and a minor effective proportion of a friction-reducing or friction-modifying additive selected from the group consisting of formamides having the following general formula

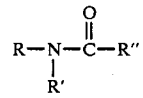

where R is $C_{10}$ to $C_{30}$ hydrocarbyl or a mixture of $C_{10}$-$C_{20}$ hydrocarbyl, R′ is hydrogen and R″ is $C_1$ alkyl.

2. The composition of claim 1 wherein R is alkyl, alkenyl, alkynyl, aryl, alkaryl, cycloalkyl or cycloaryl.

3. The composition of claim 1 wherein R is selected from the group consisting essentially of dodecyl, tetradecyl, hexadecyl, pentadecyl, coco, oleyl, tallow, stearyl, isostearyl or mixtures thereof.

4. The composition of claim 1 wherein said composition comprises an oil of lubricating viscosity.

5. The composition of claim 4 wherein said oil is a mineral or refined petroleum oil.

6. The composition of claim 4 wherein said oil of lubricating viscosity is a synthetic oil.

7. The composition of claim 4 wherein said oil of lubricating viscosity is a mixture of mineral and synthetic oils.

8. The composition of claim 1 wherein said composition comprises a grease.

9. The composition of claim 8 containing from about 0.1 to about 10 weight percent of said additive.

10. The composition of claim 9 containing from about 0.1 to 1 weight percent of said additive.

11. The composition of claim 1 wherein the N-alkyl formamide is N-oleyl formamide.

12. The composition of claim 1 wherein the formamide is N-coco formamide.

13. The lubricant composition as described in claim 1 comprising said formamide in combination with an effective amount of a zinc dithiophosphate.

14. A method for reducing fuel consumption in an internal combustion engine by treating the moving surfaces thereof with a lubricant composition comprising a major proportion of an oil of lubricating viscosity or a grease prepared therefrom and a minor effective proportion of a friction-reducing or friction-modifying additive selected from the group consisting of N-alkyl formamides having the following general formula

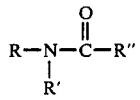

where R is $C_{10}$ to $C_{30}$ hydrocarbyl or a mixture of $C_{10}$–$C_{20}$ hydrocarbyl, R′ is hydrogen and R″ is $C_1$ alkyl.

15. The method of claim 14 wherein the formamide is an N-oleyl formamide.

* * * * *

UNITED STATES PATENT AND TRADEMARK OFFICE

CERTIFICATE OF CORRECTION

PATENT NO. : 4,743,389

DATED : May 10,1988

INVENTOR(S) : Milton Braid and Andrew G. Horodysky

It is certified that error appears in the above-identified patent and that said Letters Patent is hereby corrected as shown below:

Column 4, Claim 1, line 60, Change "R" is $C_1$ alkyl" to--R" is hydrogen--.

Column 6, Claim 14, line 19, Change " R" is $C_1$ alkyl" to--R" is hydrogen--.

Signed and Sealed this

Twenty-fifth Day of October, 1988

*Attest:*

DONALD J. QUIGG

*Attesting Officer*

*Commissioner of Patents and Trademarks*